US012331449B2

(12) United States Patent
Lee et al.

(10) Patent No.: US 12,331,449 B2
(45) **Date of Patent: *Jun. 17, 2025**

(54) WASHING MACHINE

(71) Applicant: Samsung Electronics Co., Ltd., Suwon-si (KR)

(72) Inventors: Hak Jae Lee, Suwon-si (KR); Jun Ho Kim, Suwon-si (KR); Jeong Haeng Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/397,303

(22) Filed: Dec. 27, 2023

(65) Prior Publication Data

US 2024/0125036 A1 Apr. 18, 2024

Related U.S. Application Data

(63) Continuation of application No. 17/098,617, filed on Nov. 16, 2020, now Pat. No. 11,898,298, which is a (Continued)

(30) Foreign Application Priority Data

Dec. 23, 2016 (KR) ..... 10-2016-0178555

(51) Int. Cl.
*D06F 29/00* (2006.01)
*D06F 31/00* (2006.01)
(Continued)

(52) U.S. Cl.
CPC ..... *D06F 39/10* (2013.01); *D06F 29/00* (2013.01); *D06F 31/00* (2013.01); *D06F 37/02* (2013.01)

(58) Field of Classification Search
CPC ..... D06F 37/206; D06F 37/12; D06F 37/264; D06F 23/04; D06F 31/00; D06F 37/02;
(Continued)

(56) References Cited

U.S. PATENT DOCUMENTS 1,563,822 A * 12/1925 Anderson ..... D06F 37/06 68/142
2,095,370 A * 10/1937 Reama ..... D06F 23/04 68/4

(Continued)

FOREIGN PATENT DOCUMENTS

CN 101046054 A * 10/2007
CN 104562550 A 4/2015

(Continued)

OTHER PUBLICATIONS

Extended European Search Report dated Mar. 26, 2018 in European Patent Application No. 17202564.5.

(Continued)

*Primary Examiner* — David G Cormier
*Assistant Examiner* — Thomas Bucci
(74) *Attorney, Agent, or Firm* — STAAS & HALSEY LLP

(57) ABSTRACT

A washing machine comprises a housing, a drum rotatably disposed inside the housing, a driving shaft configured to transfer a rotational force from a driving motor of the washing machine to the drum, and a driving shaft flange configured to connect the driving shaft to the drum. The driving shaft flange comprises a first surface, a second surface substantially parallel to the first surface, wherein the first surface and the second surface are spaced apart from each other by a predetermined distance in the vertical direction, and an extension portion formed perpendicular to the first surface and the second surface and connecting the (Continued)

first surface to the second surface. An edge of the first surface and an edge of the second surface and an edge of the extension portion are substantially aligned in vertical direction of the drum.

6 Claims, 12 Drawing Sheets

Related U.S. Application Data continuation of application No. 15/814,716, filed on Nov. 16, 2017, now Pat. No. 10,858,776.

(51) Int. Cl.
*D06F 37/02* (2006.01)
*D06F 39/10* (2006.01)

(58) Field of Classification Search
CPC ..... D06F 37/30; D06F 29/00; D06F 21/06; D06F 39/10; D06F 58/22; F16D 1/06
USPC ..... 68/12.13
See application file for complete search history.

(56) References Cited

U.S. PATENT DOCUMENTS 2,939,305 A * 6/1960 Neidhart ..... D06F 23/04 210/162
3,040,552 A * 6/1962 Platt ..... D06F 39/10 68/18 F
3,091,107 A * 5/1963 Rhodes ..... D06F 37/145 68/4
3,481,164 A * 12/1969 Bochan ..... D06F 13/00 68/4
3,559,426 A * 2/1971 Condit et al. ..... D06F 37/12 68/4
3,603,118 A * 9/1971 Brucken ..... D06F 37/12 68/23 R
4,848,105 A * 7/1989 O'Connell ..... D06F 39/10 210/167.01
5,373,715 A * 12/1994 Sharp ..... D06F 37/12 68/133
5,509,283 A * 4/1996 Lee ..... D06F 39/083 68/53
5,661,989 A * 9/1997 Jeon ..... D06F 39/083 68/23.5
5,849,182 A * 12/1998 Shin ..... B01D 29/52 210/167.01
5,863,423 A * 1/1999 Shin ..... D06F 39/10 210/167.01
5,989,418 A * 11/1999 Shin ..... D06F 39/10 210/167.01
6,076,378 A * 6/2000 Shin ..... D06F 39/10 68/18 F
6,918,271 B2 * 7/2005 Lim ..... D06F 37/12 68/132
7,814,769 B2 * 10/2010 Kim ..... D06F 37/225 68/253 C
7,841,800 B2 * 11/2010 Gracia Bobed ..... B21D 39/032 403/280
7,882,715 B2 * 2/2011 Yoo ..... D06F 39/10 210/167.01
7,926,310 B2 * 4/2011 Yoo ..... D06F 39/10 68/18 F
8,020,413 B2 * 9/2011 Yoo ..... D06F 39/10 68/18 F
8,336,341 B2 * 12/2012 Kim ..... D06F 37/262 68/210
8,499,590 B2 * 8/2013 Yoo ..... D06F 39/10 68/3 R
8,601,836 B2 12/2013 Kim
10,704,180 B2 * 7/2020 Fricke ..... D06F 37/30
10,858,776 B2 * 12/2020 Lee ..... D06F 29/00
11,149,377 B2 * 10/2021 Lee ..... D06F 39/125
11,898,298 B2 * 2/2024 Lee ..... D06F 39/10
2005/0138971 A1 * 6/2005 Ozturk ..... F16D 1/06 68/3 R
2005/0229651 A1 * 10/2005 Ahn ..... D06F 37/04 68/142
2006/0179897 A1 * 8/2006 Saito ..... D06F 37/04 68/23 R
2006/0254321 A1 * 11/2006 Lim ..... D06F 37/225 68/12.01
2007/0113597 A1 * 5/2007 Kim ..... B29C 65/0618 68/140
2007/0131001 A1 * 6/2007 Lee ..... D06F 37/22 68/140
2007/0277560 A1 * 12/2007 Kim ..... D06F 37/225 68/3 R
2008/0178635 A1 * 7/2008 Ratfisch ..... D06F 37/264 68/212
2008/0196452 A1 * 8/2008 Bae ..... D06F 39/10 68/237
2008/0216519 A1 * 9/2008 Yoo ..... D06F 39/10 68/12.13
2008/0216520 A1 * 9/2008 Yoo ..... D06F 39/10 210/470
2008/0216522 A1 * 9/2008 Yoo ..... D06F 39/10 210/232
2008/0216523 A1 * 9/2008 Yoo ..... D06F 39/10 68/212
2008/0217243 A1 * 9/2008 Yoo ..... D06F 39/10 210/636
2009/0038349 A1 * 2/2009 Yoon ..... D06F 37/206 68/140
2009/0113943 A1 * 5/2009 Lee ..... D06F 37/206 248/583
2009/0133447 A1 * 5/2009 Yoon ..... D06F 37/04 68/23.1
2009/0146536 A1 6/2009 Kim et al.
2009/0211312 A1 * 8/2009 Ahn ..... B29C 45/14336 68/140
2009/0235960 A1 9/2009 Yoo et al.
2010/0116002 A1 * 5/2010 Meydanli ..... D06F 37/264 68/19
2010/0275386 A1 11/2010 Ko et al.
2011/0047714 A1 3/2011 Kim et al.
2012/0222454 A1 * 9/2012 Park ..... D06F 37/30 68/133
2012/0240637 A1 * 9/2012 Lim ..... D06F 37/304 68/140
2013/0036776 A1 * 2/2013 Seo ..... D06F 37/145 68/18 F
2013/0111676 A1 * 5/2013 Jun ..... H02K 11/215 8/137
2013/0269396 A1 * 10/2013 Na ..... D06F 37/40 68/131
2013/0327098 A1 * 12/2013 Bae ..... D06F 33/47 74/572.4
2014/0026624 A1 * 1/2014 Oh ..... D06F 13/00 68/18 F
2014/0102154 A1 * 4/2014 Lee ..... D06F 39/083 68/18 F
2014/0221140 A1 * 8/2014 Garlatti ..... F16H 55/48 474/190
2014/0366283 A1 * 12/2014 Jun ..... D06F 37/04 8/137
2014/0366590 A1 * 12/2014 Bae ..... F16F 15/002 29/825
2015/0096333 A1 * 4/2015 Shu ..... D06F 37/267 68/23.6
2015/0121968 A1 * 5/2015 Kim ..... D06F 37/24 68/23.2
2015/0135777 A1 * 5/2015 Cho ..... D06F 31/00 312/228
2016/0032515 A1 * 2/2016 Lee ..... D06F 21/08 68/131

(56) References Cited

U.S. PATENT DOCUMENTS

| | | | | |
|---|---|---|---|---|
| 2016/0130741 | A1* | 5/2016 | Kim | D06F 39/10 68/18 F |
| 2016/0194801 | A1* | 7/2016 | Kim | D06F 37/264 68/212 |
| 2017/0218547 | A1* | 8/2017 | Lv | D06F 37/262 |
| 2017/0298551 | A1* | 10/2017 | Lv | D06F 35/008 |
| 2017/0356115 | A1* | 12/2017 | Choi | D06F 39/085 |
| 2018/0156335 | A1* | 6/2018 | Lv | F16J 15/122 |
| 2018/0169745 | A1* | 6/2018 | Kim | C22C 21/04 |
| 2019/0010653 | A1* | 1/2019 | Yin | D06F 37/24 |
| 2019/0010655 | A1* | 1/2019 | Lee | D06F 37/40 |
| 2019/0055688 | A1* | 2/2019 | Lee | D06F 37/40 |
| 2019/0161898 | A1* | 5/2019 | Byeon | D06F 39/10 |
| 2019/0257020 | A1* | 8/2019 | Ikeda | D06F 23/02 |
| 2020/0181825 | A1* | 6/2020 | Lasner | D06F 37/04 |
| 2020/0332453 | A1* | 10/2020 | Lin | D06F 37/40 |

FOREIGN PATENT DOCUMENTS

| | | | | |
|---|---|---|---|---|
| CN | 104652080 | A | 5/2015 | |
| CN | 104775284 | | 7/2015 | |
| CN | 204474980 | U | 7/2015 | |
| CN | 104846583 | | 8/2015 | |
| CN | 105274795 | A | 1/2016 | |
| CN | 205347800 | U | 6/2016 | |
| EP | 1789322 | | 6/2007 | |
| EP | 3121326 | A1 * | 1/2017 | D06F 37/04 |
| GB | 2189511 | A * | 10/1987 | D06F 37/262 |
| JP | 54-19563 | | 2/1979 | |
| KR | 10-2004-0078233 | | 9/2004 | |
| KR | 10-2009-0038185 | | 4/2009 | |
| KR | 20090038185 | A * | 4/2009 | |
| KR | 20-2009-0004302 | | 5/2009 | |
| KR | 10-2015-0063263 | | 6/2015 | |
| WO | WO-03080915 | A2 * | 10/2003 | B29C 33/126 |
| WO | 2012/036485 | | 3/2012 | |
| WO | 2015/096926 | | 7/2015 | |

OTHER PUBLICATIONS

International Search Report dated Feb. 27, 2018 in International Patent Application No. PCT/KR2017/012742.
European Communication dated Oct. 9, 2018 in European Patent Application No. 17202564.5.
Extended European Search Report dated Mar. 13, 2020 in European Patent Application No. 19219891.9.
Chinese Office Action dated Jul. 15, 2020 in Chinese Patent Application No. 201711237863.0.
US Office Action dated Jan. 17, 2020 in U.S. Appl. No. 15/814,716.
US Notice of Allowance dated Jul. 1, 2020 in U.S. Appl. No. 15/814,716.
Corrected Notice of Allowance dated Nov. 10, 2020 in U.S. Appl. No. 15/814,716.
Chinese Office Action dated Feb. 19, 2021, in corresponding Chinese Patent Application 201711237863.0.
Communication pursuant to Article 94(3) EPC dated Dec. 23, 2020, in corresponding European Patent Application No. 19 219 891.9.
Chinese Decision of Rejection issued Jun. 24, 2021 in Chinese Application No. 201711237863.0.
Office Action dated Nov. 29, 2022 issued in India Application No. 202118040489.
Office Action dated Nov. 30, 2022 issued in Australian Application No. 2017380379.
Office Action dated Sep. 27, 2023 issued in Korean Patent Application No. 10- 2016-0178555.
Office Action dated Aug. 11, 2023 issued in Chinse Application No. 202210145625.1.
Office Action dated Nov. 6, 2023 issued in Indian Application No. 201917029072.
Office Action dated Dec. 15, 2023 issued in Korean Application No. 10-2023- 0167094.
Office Action dated Dec. 10, 2021 in U.S. Appl. No. 17/098,617.
Final Office Action dated Jun. 24, 2022 in U.S. Appl. No. 15/814,716.
Advisory Action dated Sep. 8, 2022 in U.S. Appl. No. 15/814,716.
Office Action dated Dec. 2, 2022 in U.S. Appl. No. 15/814,716.
Final Office Action dated Jun. 12, 2023 in U.S. Appl. No. 15/814,716.
Notice of Allowance dated Sep. 27, 2023 in U.S. Appl. No. 15/814,716.
Corrected Notice of Allowability dated Nov. 22, 2023 in U.S. Appl. No. 15/814,716.
Cho et al., "Filter for washing machine", Sep. 2004, KR 20040078233A—Machine Translation (Year: 2004).
U.S. Appl. No. 15/814,716, filed Nov. 16, 2017, Hak Jae Lee, Samsung Electronics Co., Ltd.
U.S. Appl. No. 17/098,617, filed Nov. 16, 2020, Hak Jae Lee, Samsung Electronics Co., Ltd.
Office Action dated Jun. 17, 2024 issued in Korean Application No. 10-2023-0167094.
Office Action dated Jan. 23, 2024 issued in Canadian Application No. 3,048,165.

* cited by examiner

WASHING MACHINE

CROSS-REFERENCE TO RELATED APPLICATIONS

This application is a continuation application of U.S. patent application Ser. No. 17/098,617, filed on Nov. 16, 2020, which is a continuation application of U.S. patent application Ser. No. 15/814,716, filed on Nov. 16, 2017, now U.S. Pat. No. 10,858,776 issued Dec. 8, 2020, which claims the priority benefit of Korean Patent Application No. 10-2016-0178555, filed on Dec. 23, 2016 in the Korean Intellectual Property Office, the disclosures of which are incorporated herein by reference.

BACKGROUND

1. Field

The following description relates to a washing machine, and more particularly, to a washing machine having a plurality of washing apparatuses.

2. Description of the Related Art

In general, a washing machine is a machine that washes laundry by rotating a cylindrical drum containing laundry. Types of washing machines include a type of washing machine in which a drum is disposed approximately horizontally and rotates around a horizontal axis, causing laundry to rise and fall along an inner circumferential surface of the drum so that the laundry can be washed, and another type of washing machine in which a drum having a pulsator disposed therein is disposed approximately vertically and laundry is washed using a water current generated by the pulsator when the drum is rotated around a vertical axis.

A washing machine in which the drum is disposed horizontally is referred to as a front loading washing machine because a laundry port is formed in the front of the washing machine, and a washing machine in which the drum is disposed vertically is referred to as a top loading washing machine because a laundry port is formed at an upper portion of the washing machine.

However, because a washing machine according to the related art has only one washing device, when laundry needs to be separated and washed, a user has to use the washing machine twice or more. Thus, the user needs to use the washing machine for a long time even though there may be a relatively small amount of laundry.

SUMMARY

Therefore, it is an aspect of the present disclosure to provide a washing machine having a plurality of washing apparatuses.

It is an aspect of the present disclosure to provide a washing machine in which foreign substances can be easily collected inside a washing device disposed at an upper portion of the washing machine among a plurality of washing apparatuses provided in the washing machine.

It is an aspect of the present disclosure to provide a washing machine in which a washing device disposed at an upper portion of the washing machine among a plurality of washing apparatuses provided in the washing machine can be stably driven.

Additional aspects of the disclosure will be set forth in part in the description which follows and, in part, will be obvious from the description, or may be learned by practice of the disclosure.

In accordance with one aspect of the present disclosure, a washing machine includes: a housing; a drum disposed inside the housing and including a rotation shaft that extends in a vertical direction; and a filter unit disposed at an inner wall of the drum, configured to filter washing water flowing in a circumferential direction of the drum and to discharge the washing water in an inward radial direction inside of the drum.

The filter unit may include: a first opening opened toward one side of the filter unit with respect to the circumferential direction of the drum; a discharge portion configured to discharge the washing water, flowing through the first opening, in an inward radial direction inside of the drum; and a first valve member configured to allow the washing water flowing through the first opening to flow into the discharge portion.

The filter unit may include: a second opening opened toward an opposite side of the filter unit with respect to the circumferential direction of the drum; and a second valve member configured to allow the washing water flowing through the second opening to flow into the discharge portion.

When the washing water flows into the filter unit through the first opening, the second valve member may prevent the washing water flowing into the filter unit from flowing into the second opening and may be configured to guide the washing water toward the discharge portion.

When the washing water flows into the filter unit through the second opening, the first valve member may prevent the washing water flowing into the filter unit from flowing into the first opening and may be configured to guide the washing water toward the discharge portion.

The filter unit may further include a first frame, a second frame rotatably coupled to the first frame and having the discharge portion formed therein, and a cover member configured to cover the first frame and the second frame.

The filter unit may further include a filter member configured to filter foreign substances in the washing water and disposed between the first frame and the second frame, and the filter member may be exposed when the second frame is rotated toward the rotation shaft.

The washing water flowing into the filter unit through the first opening or the second opening may transmit the filter member and may be discharged toward an outside of the filter unit through the discharge portion.

The first opening may be disposed in one side of the cover member, and the second opening may be disposed in an opposite side of the cover member.

The first valve member and the second valve member may be supported on the second frame.

The filter unit may further include a hook member configured to be hook-coupled to an inner wall of the drum.

The filter unit may protrude from the inner wall of the drum facing a rotation shaft of the drum.

The washing machine may further include: a driving shaft configured to transfer a rotational force generated in a driving motor to the drum; and a driving shaft flange configured to connect the driving shaft to the drum, wherein a distance from a central side of the driving shaft flange to an outermost end of the driving shaft flange in a radial direction of the drum is equal to or less than ½ of a radius of the drum.

The driving shaft flange may include a first surface, a second surface parallel to the first surface, and a connection portion formed perpendicular to the first surface and the second surface and connecting the first surface to the second surface.

The washing machine may further include: a lower drum disposed at a lower side of the drum and including a rotation shaft that extends in a forward/backward direction; a first door opened upward so that laundry is put into the drum through the first door; and a second door opened forward so that the laundry is put into the lower drum through the second door.

In accordance with an aspect of the present disclosure, a washing machine includes: a housing; a drum disposed inside the housing and including a rotation shaft that extends in a vertical direction; and a filter unit disposed at an inner wall of the drum, configured to filter washing water flowing in a circumferential direction of the drum, wherein the filter unit includes: a first valve member disposed at one side of the filter unit in the circumferential direction of the drum, configured to let through the washing water flowing into one side of the filter unit and to prevent the washing water flowing into the other side of the filter unit from flowing into the one side of the filter unit; and a second valve member disposed at the other side of the filter unit in the circumferential direction of the drum, configured to let through the washing water flowing into the other side of the filter unit and to prevent the washing water flowing into the one side of the filter unit from flowing into the other side of the filter unit.

The filter unit may further include a discharge portion, which is formed facing a rotation shaft of the drum and through which the washing water flowing into the filter unit is discharged, and the second valve member may guide the washing water flowing into one side of the filter unit to flow into the discharge portion.

The first valve member may guide the washing water flowing into the other side of the filter unit to flow into the discharge portion.

In accordance with an aspect of the present disclosure, a washing machine includes: a first drum including a rotation shaft that extends in a vertical direction; a second drum disposed at a lower side of the first drum and including a rotation shaft that extends in a forward/backward direction; a housing configured to cover the first drum and the second drum and including a first opening opened upward to correspond to the first drum and a second opening opened forward to correspond to the second drum; and a filter unit disposed at an inner wall of the first drum, configured to filter washing water flowing in a circumferential direction of the first drum and to discharge the washing water in an inward radial direction inside of the first drum.

The washing machine may further include: a driving shaft disposed between the first drum and the second drum and configured to transfer a rotational force generated in a driving motor to the first drum; and a driving shaft flange disposed at a bottom end of the first drum to connect the driving shaft to the first drum, wherein a distance from a central side of the driving shaft flange to an outermost end of the driving shaft flange in a radial direction of the first drum is equal to or less than ½ of a radius of the first drum.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
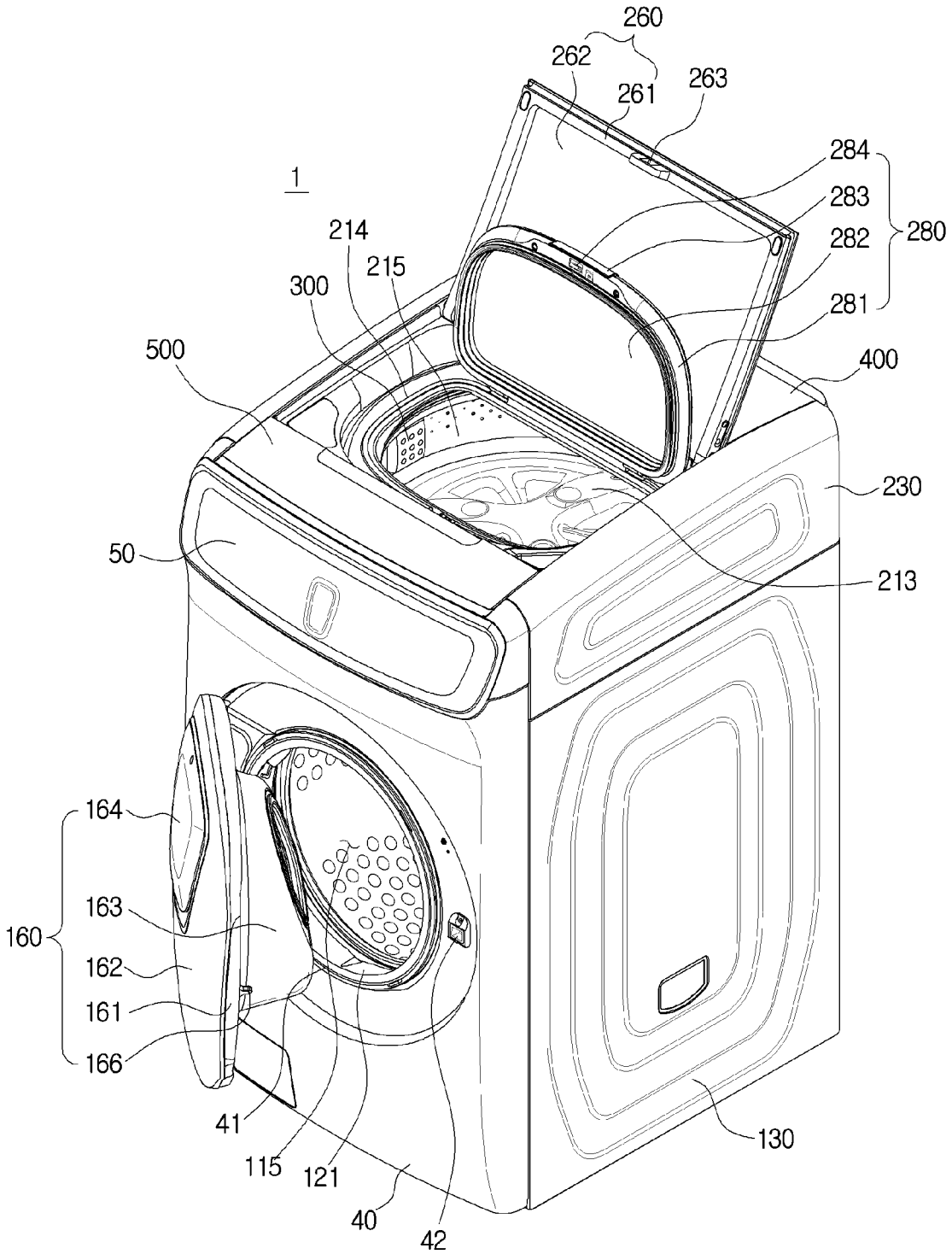
FIG. 1 is a perspective view of a washing machine according to an embodiment of the present disclosure.

Embodiments described in the present specification and configuration shown in the drawings are just exemplary embodiments of the disclosure, and there may be various modifications that may replace the embodiments of the present specification and the drawings at the time of filing the present application.

Like reference numerals or symbols in each of the drawings of the present specification represent components or elements that perform materially the same functions.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

It will be understood that although the terms first and second are used herein to describe various elements, these elements should not be limited by these terms. These terms are only used to distinguish one element from another element. Thus, a first element discussed below could be termed a second element, and similarly, a second element may be termed a first element without departing from the teachings of this disclosure. As used herein, the term "and/or" includes any and all combinations of one or more of the associated listed items.

The terms used herein, such as a "front end", a "rear end", an "upper portion", a "lower portion", a "top end", and a "bottom end", are defined based on the drawings, and the shape and position of each element are not limited by the terms.

Hereinafter, embodiments of the present disclosure will be described in detail with reference to the attached drawings.

Figure 2:
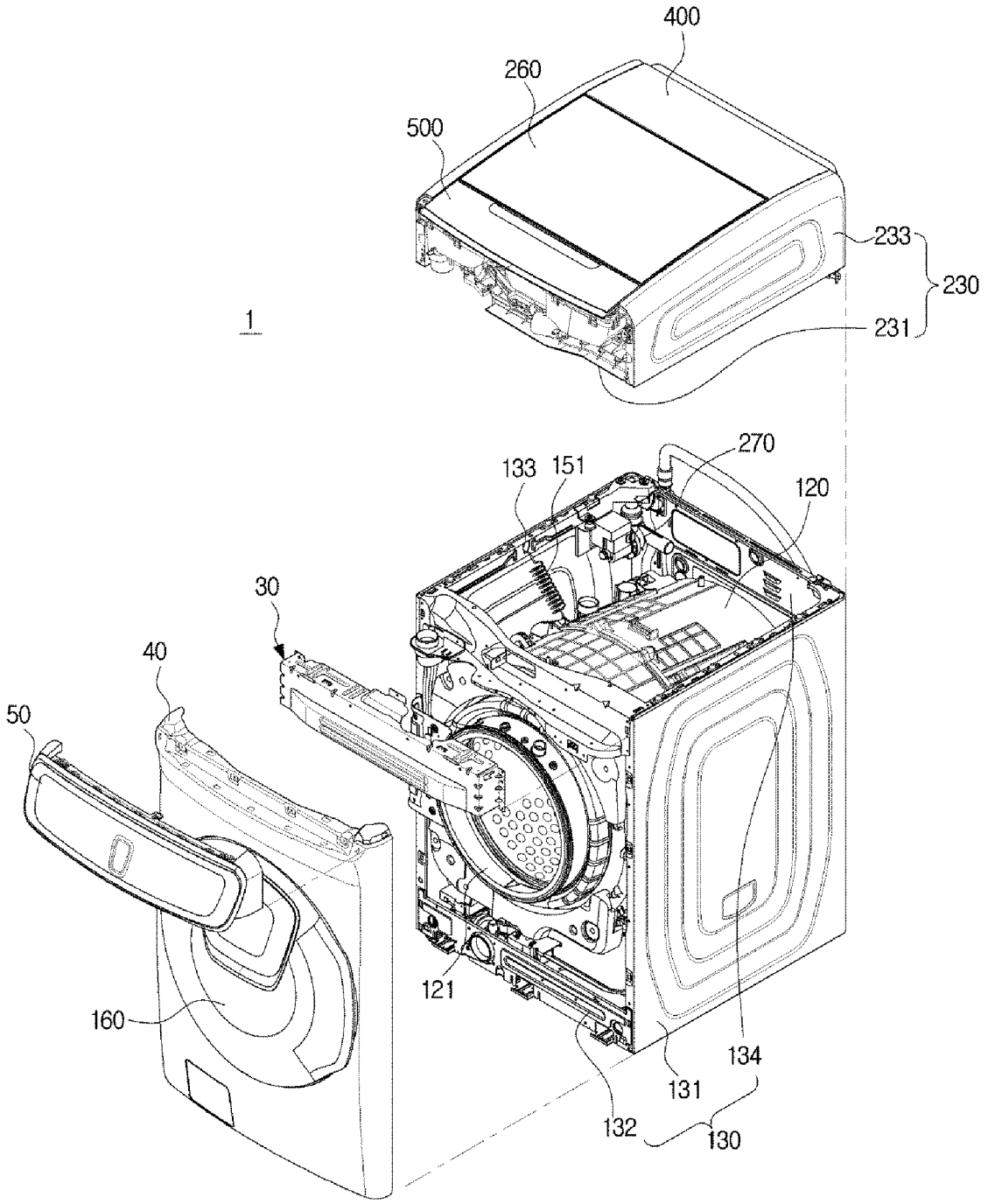
FIG. 2 is a view of a first washing device and a second washing device of the washing machine illustrated in FIG. 1 that are separated from each other.
Figure 3:
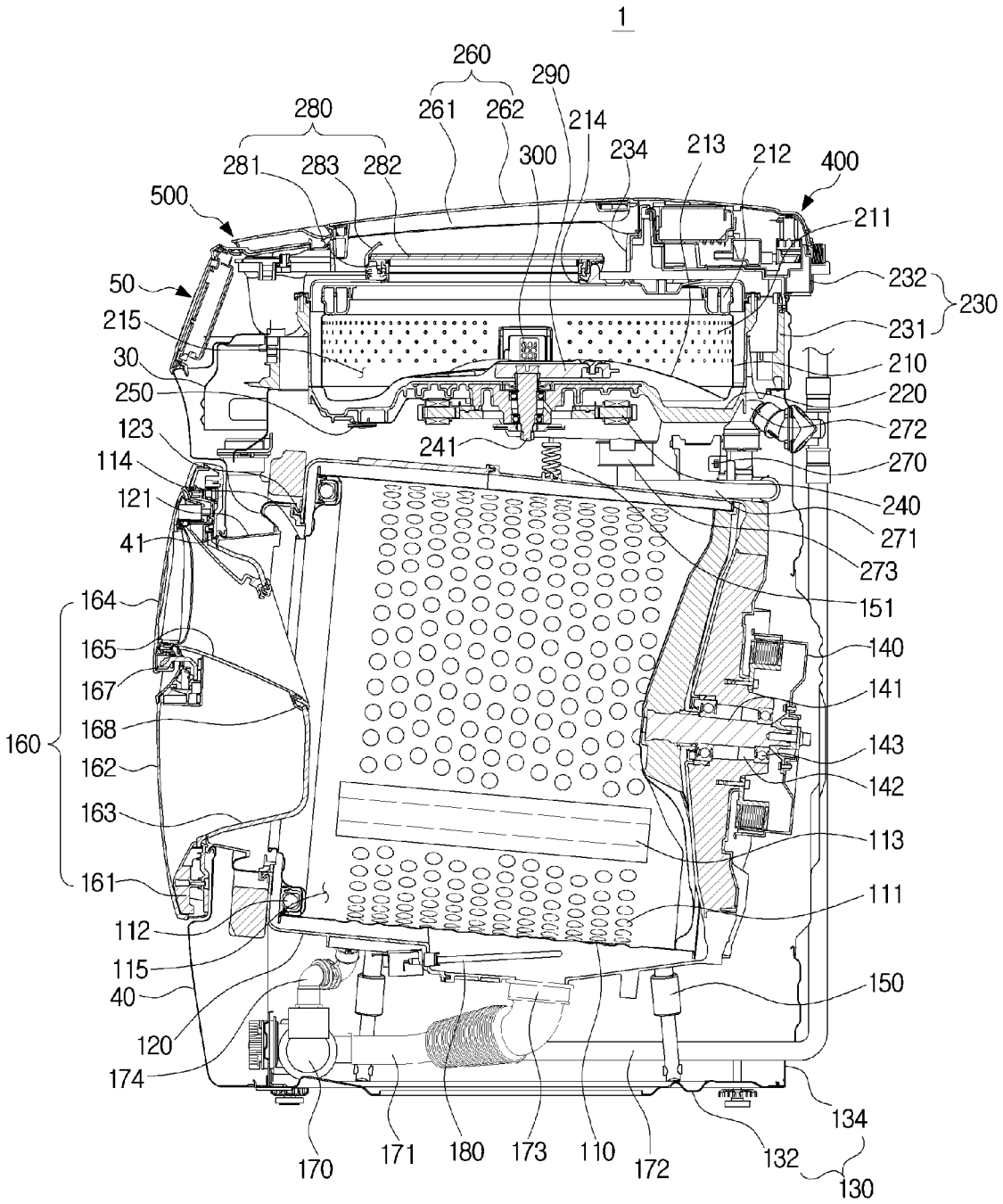
FIG. 3 is a cross-sectional view of the washing machine of FIG. 1.

FIG. 1 is a perspective view of a washing machine according to an embodiment of the present disclosure, FIG. 2 is a view of a first washing device and a second washing device of the washing machine illustrated in FIG. 1 that are separated from each other, and FIG. 3 is a cross-sectional view of the washing machine of FIG. 1.

As illustrated in FIGS. 1 through 3, a washing machine 1 may include a front loading type of first washing device in which a laundry port is formed in front of a first washing space 115, and a top loading type of second washing device in which the laundry port is formed at an upper portion of a second washing space 215.

The washing machine 1 may include a first drum 110 having the first washing space 115 formed therein, and a first tub 120 in which the first drum 110 is accommodated and washing water or rinsing water to be used in a washing operation or a rinsing operation is stored. The first drum 110 and the first tub 120 may have a cylindrical shape in which at least a portion of one surface of the first drum 110 and the first tub 120 is open, and the open surface may face the front. In detail, the first drum 110 may include an opening 114 which is formed in the front of the washing machine 1 and through which laundry is to be put into the first drum 110, and the first tub 120 may include an opening 123 which is formed in the front of the washing machine 1 and through which the laundry is to be put into the first tub 120.

The washing machine 1 may include a first housing 130 in which the first drum 110 and the first tub 120 are disposed. In detail, the first housing 130 having an open top portion may include a pair of first side plates 131 that form side surfaces of the first housing 130, a first rear plate 134 that forms a rear surface of the first housing 130, and a lower plate 132 that forms a bottom surface of the first housing 130. The pair of first side plates 131 and the first rear plate 134 may be integrally formed.

In addition, the washing machine 1 may include a spring 151 and a damper 150 that are capable of supporting the first tub 120 in the first housing 130. The damper 150 may support the first tub 120 at a lower side of the first housing 130 by connecting an outside surface of the first tub 120 to the lower plate 132, and the spring 151 may support the first tub 120 at an upper side of the first housing 130 by connecting the outside surface of the first tub 120 to a spring coupling portion 133 disposed at an upper portion of the first side plate 131. The spring 151 and the damper 150 may alleviate vibration, noise, and shock that occur due to a movement of the first tub 120.

An installation position of the spring 151 and the damper 150 is not limited to the upper portion of the first side plates 131 and the lower plate 132, and the first tub 120 may also be supported by connecting one side surface of the first tub 120 and another portion of the first housing 130 if necessary.

The washing machine 1 may include a first driving motor 140 that is disposed behind the first tub 120 and rotates the first drum 110. A first driving shaft 141 for transferring power of the first driving motor 140 may be connected to a rear surface of the first drum 110.

A plurality of first through holes 111 through which washing water flows may be formed in a circumference of the first drum 110. A plurality of lifters 113 may be installed at an inner circumferential surface of the first drum 110 so that, when the first drum 110 is rotated, the laundry can be lifted and dropped. A first balancer 112 may be mounted on the front of the first drum 110 so that the first drum 110 can be stably rotated during high-speed rotation.

A first driving shaft 141 may be disposed between the first drum 110 and the first driving motor 140. One end of the first driving shaft 141 is connected to a rear plate of the first drum 110, and the other end of the first driving shaft 141 extends to an outside of a rear wall of the first tub 120. When the first driving motor 140 drives the first driving shaft 141, the first drum 110 connected to the first driving shaft 141 is rotated around the first driving shaft 141.

A bearing housing 142 may be installed at the rear wall of the first tub 120 to rotatably support the first driving shaft 141. The bearing housing 142 may be formed of an aluminum alloy and may be inserted into the rear wall of the first tub 120 when the first tub 120 is injection-molded. Bearings 143 are installed between the bearing housing 142 and the first driving shaft 141 so that the first driving shaft 141 can be smoothly rotated.

The washing machine 1 may include a function of washing the laundry with high-temperature water. In order to attain high-temperature water, a heater 180 may be disposed at a bottom surface of the first tub 120 to heat washing water or rinsing water accommodated in the first tub 120.

The washing machine 1 may include a first drainage pump 170, which is disposed below the first tub 120 and discharges water inside the first tub 120 out of the washing machine 1; a first connection hose 171, which connects a first drain 173 of the first tub 120 to the first drainage pump 170 so that water inside the first tub 120 can flow into the first drainage pump 170; a circulation hose 174, which connects the first drainage pump 170 to the first tub 120 so that water that flows into the first drainage pump 170 can be circulated into the first tub 120; and first drainage holes 172, which guide water pumped by the first drainage pump 170 out of the washing machine 1.

The washing machine 1 may include a front cover 40 having a first laundry port 41 through which the laundry can be put into the washing machine 1 and which is formed in the first washing space 115, and a first door 160 for opening/closing the first laundry port 41 may be coupled to the front cover 40.

The first door 160 may correspond to the first laundry port 41 and may be rotated with respect to the front cover 40. The first door 160 may include a first door frame 161, a first door cover 162, and a door glass 163.

In an embodiment of the present disclosure, the first door frame 161 has an approximately annular shape but may also have an approximately rectangular shape. The first door cover 162 and the door glass 163 may be formed of a transparent material so that a user can see an inside of the first drum 110 from the outside of the washing machine 1 even when the first door 160 closes the first laundry port 41. The door glass 163 may protrude from the first door frame 161 convexly toward the inside of the first drum 110. Through this configuration, the door glass 163 may be inserted into an inside of the first laundry port 41 when the first door 160 is closed.

A first hinge (not shown) is disposed on the periphery of the first laundry port 41 so that the first door 160 can be rotated with respect to the front cover 40. The first hinge is coupled to a first hinge coupling portion (not shown) formed at one side of the first door frame 161. A first hook 166 is disposed at the other side of the first door frame 161, and a first hook accommodation portion 42 is disposed at the front cover 40 to correspond to the first hook 166 so that the first door 160 can be able to close the first laundry port 41.

The first door 160 may include an auxiliary laundry port 167, and an auxiliary door 164 for opening/closing the auxiliary laundry port 167 so that, even when the first door 160 is closed, the laundry can be put into the first washing space 115. The auxiliary door 164 may be rotatably mounted on the first door cover 162.

The laundry needs to pass through the door glass 163 so that the laundry can be put into the washing machine 1 through the auxiliary laundry port 167 of the first door 160. To this end, a glass through-hole 168 is formed in the door glass 163. As an alternative, an upper portion of the door glass 163 may be sunken so that no door glass can be disposed behind the auxiliary laundry port 167.

In order to connect the auxiliary laundry port 167 of the first door 160 to the glass through-hole 168 of the door glass 163, the first door 160 may include a connection guide portion 165. The connection guide portion 165 may have both opened ends and a shape of a tube with a hollow portion.

In detail, one end of the connection guide portion 165 is connected to the auxiliary laundry port 167, and the other end of the connection guide portion 165 is connected to the glass-through hole 168. In the current embodiment, the connection guide portion 165 may be inclined downward from the front to the rear. That is, one end of the connection guide portion 165 connected to the auxiliary laundry port 167 may be higher than the other end thereof. Through this configuration, the user may put the laundry into the inside of the first drum 110 through the auxiliary laundry port 167 easily.

In the current embodiment, the auxiliary door 164 is provided in the first door 160. However, embodiments of the present disclosure are not limited thereto, and the first door 160 may be configured without an auxiliary laundry port, an auxiliary door, or a connection guide portion.

The washing machine 1 may include a diaphragm 121 disposed between the first laundry port 41 of the front cover 40 and the opening 123 of the first tub 120. The diaphragm 121 may form a path from the first laundry port 41 to the opening 114 of the first drum 110 and may reduce vibration transferred to the front cover 40 when the first drum 110 is rotated. Also, a portion of the diaphragm 121 may be disposed between the first door 160 and the front cover 40 so that washing water in the first tub 120 can be prevented from leaking out of the washing machine 1.

The washing machine 1 may include a second drum 210 having a second washing space 215 formed therein, and a second tub 220 in which the second drum 210 is accommodated and washing water or rinsing water to be used in a washing operation or rinsing operation is stored. The second drum 210 and the second tub 220 may have a cylindrical shape in which at least a portion of one side surface thereof is open, and the open side surface may face upward.

The washing machine 1 may include a second housing 230 in which the second drum 210 and the second tub 220 are disposed and which has an open lower portion. In detail, the second housing 230 may include a lower frame 231, which has open upper and lower portions and on which the second tub 220 is supported, and an upper frame 232 having a second laundry port 234, which is formed in the second washing space 215 and through which the laundry can be put into the washing machine 1, the upper frame 232 being mounted on an upper portion of the lower frame 231. Also, the second housing 230 may include a side cover 233 that forms the exterior of a left side surface and a right side surface.

The washing machine 1 may include a second door 260, which is disposed in the second housing 230 and opens/closes the second laundry port 234. The second door 260 may correspond to the second laundry port 234 and may be rotated with respect to the upper frame 232. The second door 260 may include a second door frame 261 and a second door cover 262. The second door cover 262 may be formed of a transparent material so that, even when the second door 260 closes the second laundry port 234, the user can see through the second tub 220 and the second drum 210 from the outside of the washing machine 1.

Second hinges (not shown) are provided at both left and right sides of the second door frame 261 so that the second door 260 can be rotated with respect to the upper frame 232. The second hinges are coupled to a second hinge coupling portion (not shown) formed on the periphery of the second laundry port 234. A latch accommodation portion 263 may be provided in front of the second door frame 261, and a latch device (not shown) may be provided in the upper frame 232 to correspond to the latch accommodation portion 263 of the second door frame 261 so that the second door 260 can be able to close the second laundry port 234.

The second drum 210 may have a cylindrical shape with an open top surface and may be rotated inside the second tub 220. A plurality of second through-holes 211 through which washing water flows may be formed in side surfaces and a bottom surface of the second drum 210. A second balancer 212 may be mounted on an upper portion of the second drum 210 so that the second drum 210 can be stably rotated during high-speed rotation. A curved portion 213 for generating a water current may be formed on the bottom surface of the second drum 210.

A filter unit 300 may be attached to an inside surface of the second drum 210 to filter foreign substances that may appear during washing. The filter unit 300 will be described below in detail.

The second tub 220 may have a cylindrical shape and may be supported on the lower frame 231 by using a suspension device 250. In detail, the second tub 220 may be supported in a suspended form on the lower frame 231 by four suspension devices 250. A third laundry port 214 may be disposed at a top surface of the second tub 220 to correspond to the second laundry port 234, and a third door 280 for opening/closing the third laundry port 214 may be coupled to the third laundry port 214.

The third door 280 may include a third door frame 281 and a third door cover 282. The third door cover 282 may be formed of a transparent material so that, even when the third door 280 closes the third laundry port 214, the user can see the inside of the second drum 210 from the outside of the second tub 220.

A third hinge (not shown) is provided on the periphery of the third laundry port 214 so that the third door 280 can be rotated with respect to the second tub 220. The third hinge is coupled to a third hinge coupling portion (not shown) formed at one side of the third door frame 281. A handle 283 for opening the third door 280 may be provided at the other side of the third door frame 281, and a second hook 284 may be provided at the handle 283. A second hook accommodation portion (not shown) may be provided in the second tub 220 to correspond to the second hook 284 so that the third door 280 can be able to close the third laundry port 214. When the handle 283 is pulled, the second hook 284 can be separated from the second hook accommodation portion and thus the third door 280 can be opened.

The washing machine 1 may include a second driving motor 240, which is disposed outside a lower side of the second tub 220 and rotates the second drum 210. A second driving shaft 241 for transferring power of the second driving motor 240 may be connected to the bottom surface of the second drum 210. One end of the second driving shaft 241 is connected to a bottom surface plate of the second drum 210, and the other end of the second driving shaft 241 extends toward an outside of a lower wall of the second tub 220. When the second driving motor 240 drives the second driving shaft 241, the second drum 210 connected to the second driving shaft 241 is rotated around the second driving shaft 241.

The washing machine 1 may include a second drainage pump 270, which is disposed below the second tub 220 and discharges water inside the second tub 220 out of the washing machine 1, and a second drainage hose 272, which guides water pumped by the second drainage pump 270 out of the washing machine 1. In detail, the second drainage pump 270 may be mounted on an upper portion of the first housing 130.

A second drainage 273 through which water in the second tub 220 can be discharged may be formed at a bottom surface of the second tub 220, and the second drainage 273 and the second drainage pump 270 may be connected to each other by using a second connection hose 271 so that water in the second tub 220 can flow into the second drainage pump 270.

The washing machine 1 may include a water supply device 400 that is capable of supplying washing water to the first tub 120 and the second tub 220. The water supply device 400 may be disposed in the second housing 230. In detail, the water supply device 400 may be disposed in the upper frame 232, and behind the second laundry port 234.

In addition, the laundry 1 may include a detergent supply device 500 that is capable of supplying detergent to the first tub 120. The detergent supply device 500 may be disposed in the second housing 230. In detail, the detergent supply device 500 may be disposed in the upper frame 232, and in front of the second laundry port 234.

The washing machine 1 may include a fixing bracket 30 that couples the first housing 130 to the second housing 230 so that the first housing 130 and the second housing 230 cannot be separated from each other. The fixing bracket 30 may be coupled to the front of the first housing 130 and the front of the second housing 230.

In addition, the washing machine 1 may include a control panel 50, which is disposed on the front cover 40 and through which the washing machine 1 can be operated. The control panel 50 may include an input unit through which operation instructions for the washing machine 1 can be input from the user, and a display unit on which operation information about the washing machine 1 is displayed.

Hereinafter, the filter unit 300 disposed inside the second drum 210 will be described in detail.

Figure 4:
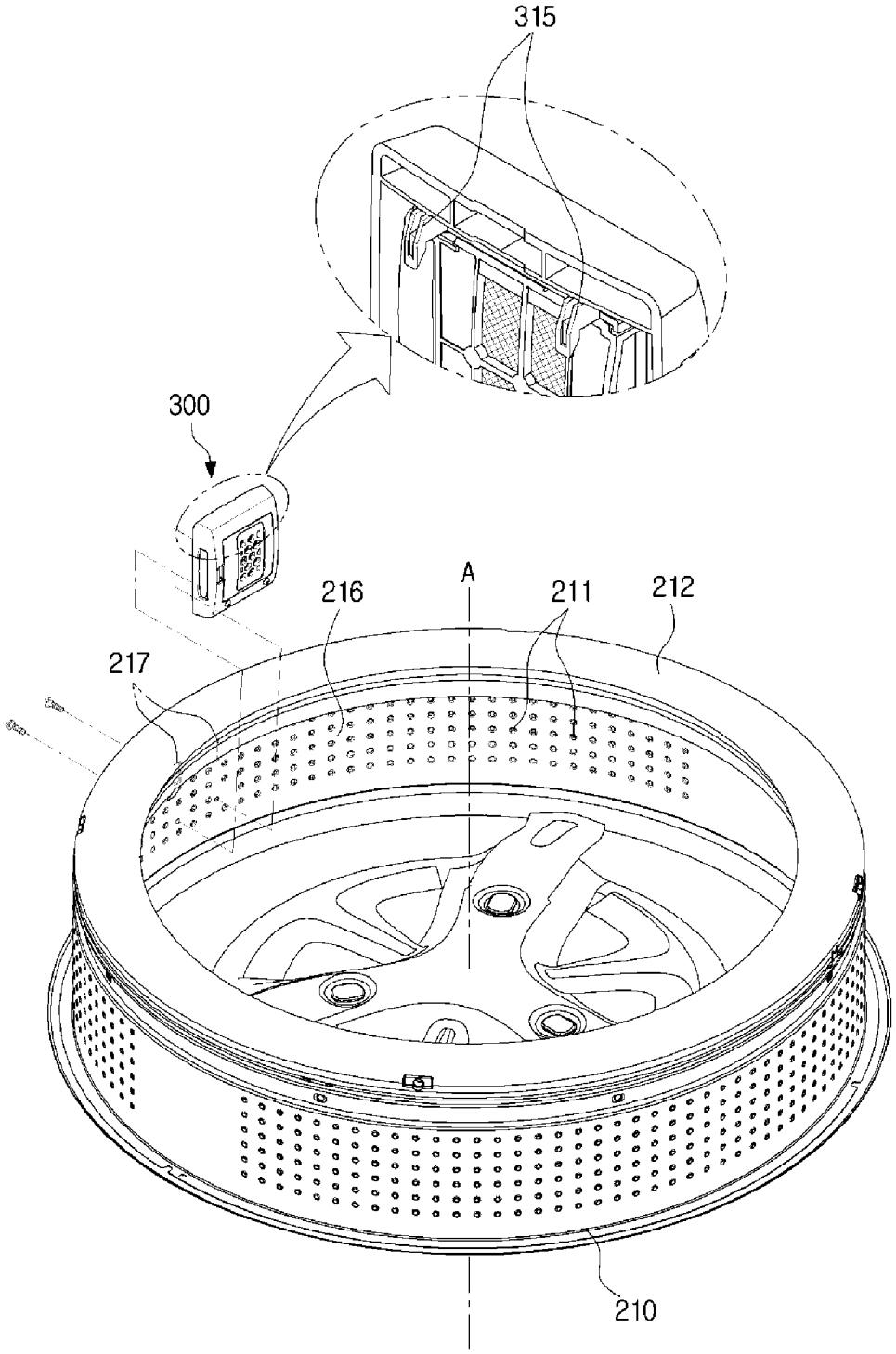
FIG. 4 is an exploded perspective view of a portion of a configuration of the second washing device of the washing machine of FIG. 1.
Figure 5:
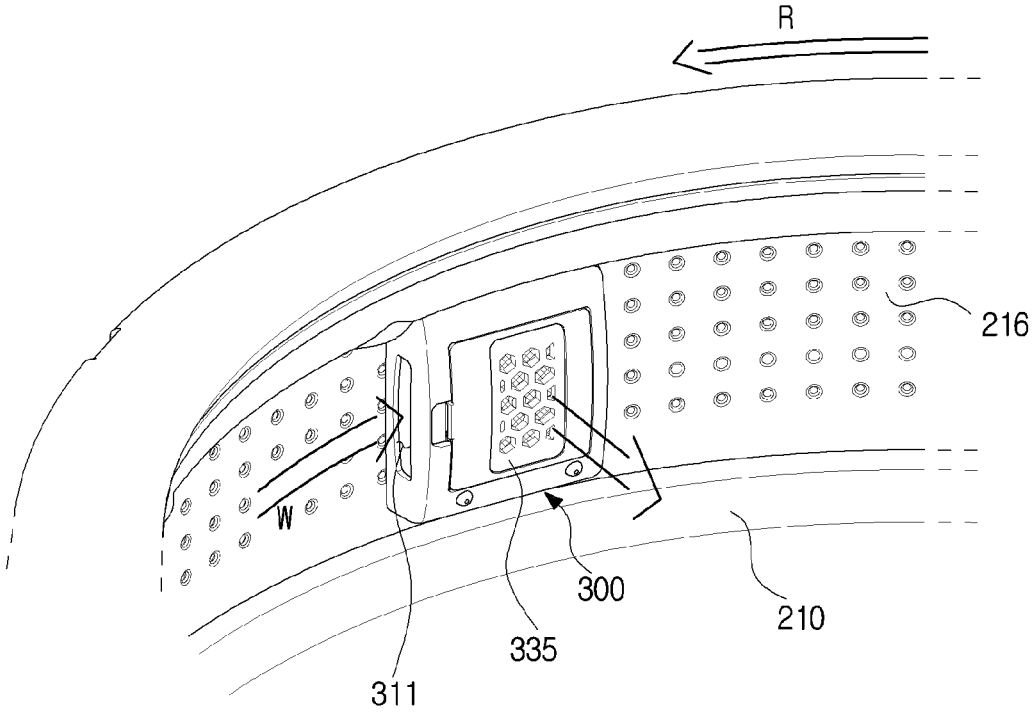
FIG. 5 is a view showing a state in which a filter of the second washing device of the washing machine of FIG. 1 is disposed inside a second drum.
Figure 6:
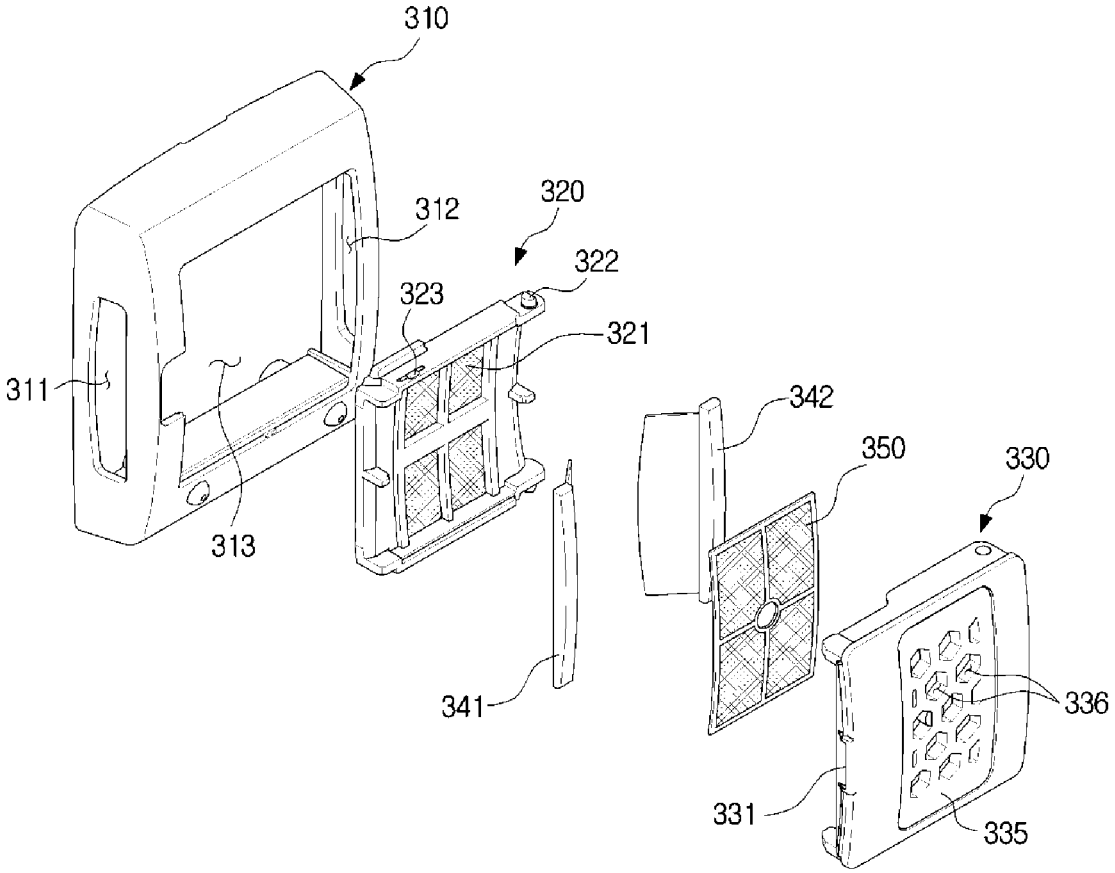
FIG. 6 is an exploded perspective view of the filter of the second washing device of the washing machine of FIG. 1.
Figure 7:
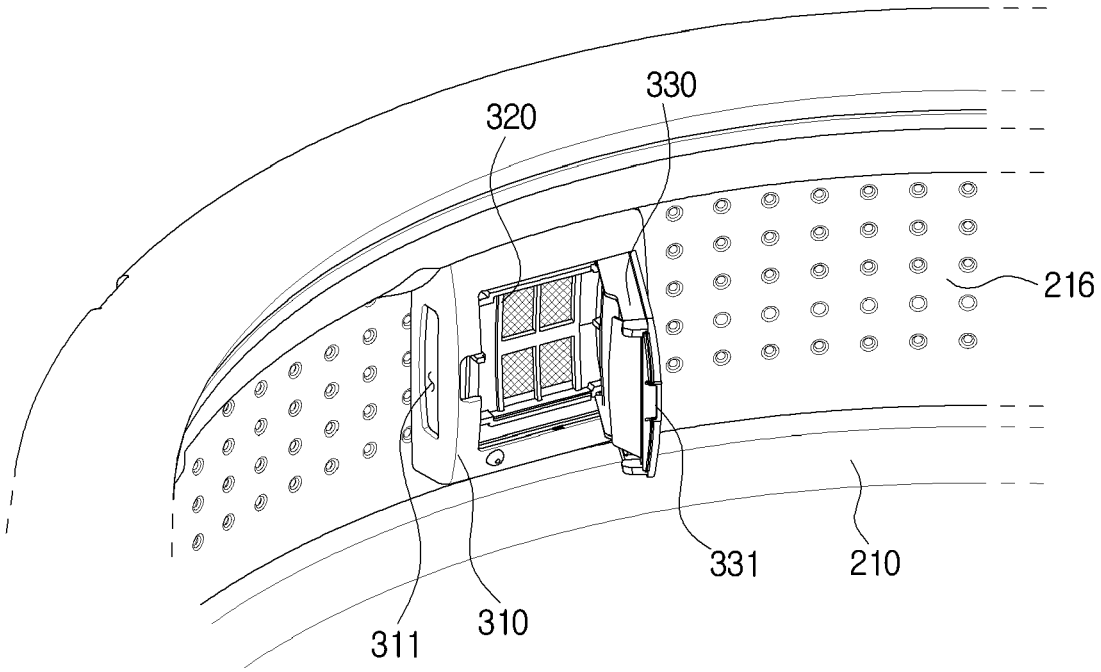
FIG. 7 is a view showing a state in which the filter of the second washing device of the washing machine of FIG. 6 is open.

FIG. 4 is an exploded perspective view of a portion of a configuration of the second washing device of the washing machine of FIG. 1, FIG. 5 is a view showing a state in which a filter of the second washing device of the washing machine of FIG. 1 is disposed inside a second drum, FIG. 6 is an exploded perspective view of the filter of the second washing device of the washing machine of FIG. 1, and FIG. 7 is a view showing a state in which the filter of the second washing device of the washing machine of FIG. 6 has been opened.

A fully automatic washing machine according to the related art includes a pulsator disposed inside a drum. The pulsator is rotated at a lower portion of the drum and forms a water current in a vertical direction so that washing water and the laundry are stirred and the laundry can be washed.

In order to prevent foreign substances from flowing into the drum together with the washing water while the laundry is being washed, a filter that filters upward-flowing washing water into the drum is provided at an upper portion of the drum.

Alternatively, a filter is provided outside the drum to filter the washing water flowing through an additional flow path. The filter filters the washing water flowing upward by use of the pulsator, and the washing water flows downward again and flows into the drum.

The washing machine 1 according to an embodiment of the present disclosure may include both the first drum 110 of a drum-type washing machine having a rotation shaft that extends in a forward/backward direction, and the second drum 210 of a fully automatic-type washing machine, which is disposed at an upper side of the first drum 110 and has a rotation shaft that extends in the vertical direction.

Thus, both the first drum 110 and the second drum 210 may be disposed inside a housing of one washing machine 1, and no pulsator may be disposed inside the second drum 210 due to a limitation of a space in the vertical direction, and a water current may be formed due to a rotational force of the second drum 210 so that the laundry can be washed.

Thus, no water current may be formed in the vertical direction but a water current may be formed in a direction opposite a rotation direction of the second drum 210.

In order to filter foreign substances in the water current formed in a direction opposite the rotation direction of the second drum 210, the filter unit 300 may be disposed at an inner wall 216 of the second drum 210, i.e., inside the second drum 210 to filter foreign substances that flow in due to the water current formed in the direction opposite the rotation direction of the second drum 210.

However, the filter unit 300 according to an embodiment of the present disclosure may be included not only in the washing machine 1 including a plurality of drums 110 and 210 as described above, but also in a washing machine having one drum in which a water current is formed in a circumferential direction of the drum.

In detail, the filter unit 300 may be disposed at the inner wall 216 of the second drum 210, as illustrated in FIG. 4. The filter unit 300 may include a hook member 315 that extends from a rear side surface of the filter unit 300. The hook member 315 may be hook-coupled to a hook groove 217 formed in one side of the inner wall 216 so that the filter unit 300 can be disposed at an inside surface of the inner wall 216.

In addition, the rear side surface of the filter unit 300 and the inner wall 216 may be screw-coupled to each other so that the filter unit 300 can be stably supported on the inner wall 216 of the second drum 210.

As illustrated in FIG. 5, the filter unit 300 may include a first opening 311 disposed in one side of the filter unit 300 in the circumferential direction of the second drum 210. When the second drum 210 is rotated in one direction R, due to a rotational force of the second drum 210, the washing water inside the second drum 210 may form a water current W rotating in direction opposite a rotation direction R of the second drum 210.

In this case, the water current W rotating in the direction opposite the rotation direction R of the second drum 210 may pass through a first opening 311 of the filter unit 300 along the inner wall 216 of the second drum 210 and may flow into the filter unit 300.

The washing water flowing into the filter unit 300 may be discharged out of the filter unit 300 through a discharge portion 335 formed in an inward radial direction inside of the second drum 210.

That is, the washing water may rotate in the circumferential direction of the second drum 210 and flow into the filter unit 300 in the circumferential direction of the second drum 210, and when foreign substances are filtered inside the filter unit 300, a flow direction of the washing water may be changed and the washing water may be discharged by the filter unit 300 in an inward radial direction inside of the second drum 210.

A first valve member 341 may be disposed at one side of the filter unit 300 so that the washing water introduced through the first opening 311 flows into the discharge portion 335. However, the washing water flowing into the inside of the filter unit 300 is limited to being discharged through the first opening 311 so that a direction of a water current of the washing water can be changed. This will now be described in detail.

In addition, the filter unit 300 may be disposed to protrude inward from the inner wall 216 of the second drum 210. The water current W may be formed in the circumferential direction of the second drum 210, as described above. Thus, the laundry may be moved in the circumferential direction of the second drum 210 together with the water current W and washed.

In this case, the water current W of the washing water is formed only in one direction of the circumferential direction of the second drum 210 or an opposite direction thereto so that the laundry can be rotated together with the water current W in a state in which the laundry is crumpled, and thus efficiency of washing can deteriorate.

However, because the filter unit 300 protrudes toward the inside of the second drum 210, the filter unit 300 may collide with the laundry rotated together with the water current W so that the laundry can be dispersed. Thus, the filter unit 300 performs a function of dispersing the rotated laundry so that washing efficiency of the laundry can be improved.

The filter unit 300 may filter foreign substances that exist in the washing water and may change the flow direction of the water current W as described above so that the laundry and the washing water are stirred in various directions and thus efficiency of washing can be improved.

As described above, the filter unit 300 includes only one first opening 311 through which only the washing water flowing in a direction opposite the rotation direction R of the second drum 210 flows into the filter unit 300.

However, although not shown in FIG. 5, the filter unit 300 according to an embodiment of the present disclosure includes a second opening 312 provided in an opposite side of the first opening 311 so that, when the second drum 210 is rotated in the opposite direction, the washing water flowing in a direction opposite a rotation direction of the second drum 210 may flow into the filter unit 300. Also, the filter unit 300 includes a second valve member 342 disposed adjacent to the second opening 312 to guide the washing water flowing into the second opening 312 into the discharge portion 335 and not be discharged through the second opening 312.

The second drum 210 is rotated in one direction R and a direction opposite a rotation direction of the second drum 210 during a washing operation to change a washing water current. The washing water flows into the second drum 210 through the first opening 311 and the second opening 312 regardless of the rotation direction of the second drum 210 so that the filter unit 300 may perform filtering of the washing water.

As illustrated in FIG. 6, the filter member 300 may include a cover member 310 that has one side having a first opening 311 formed therein and the other side having a second opening 312 formed therein and covers a first frame 320 and a second frame 330.

The cover member 310 may form a space for filtering by the filter member 350 when a flow direction of the washing water flowing through the first opening 311 or the second opening 312 is changed. A rear side surface of the cover member 310 is open but may be closed by the inner wall 216 of the second drum 210, and a front side of the cover member 310 may include an opening portion 313 through which the second frame 330 is exposed.

The first frame 320 may be disposed inside the cover member 310. The first frame 320 may rotatably support the second frame 330. However, embodiments of the present disclosure are not limited thereto, and the second frame 330 may also be rotatably supported on the cover member 310.

The first frame 320 may include an exit prevention member 321 disposed at a rear side surface of the first frame 320 to prevent collected foreign substances from flowing to the rear side surface of the filter unit 300. The exit prevention member 321 may include a mesh member to prevent the foreign substances collected by the filter member 350 from flowing into the second drum 210 through the rear side surface of the filter unit 300.

Rotation protrusions 322 may be provided on one side of the first frame 320 so that the second frame 330 can be rotatably coupled to the first frame 320. A pair of rotation protrusions 322 may be formed at upper and lower sides of the first frame 320, and an insertion groove (not shown) into which the pair of rotation protrusions 322 are inserted may be formed in the second frame 330 so that the second frame 330 can be rotatably coupled, centering on the rotation protrusions 322, to the first frame 320.

A fixing portion 323 may be provided at the other side of the first frame 320 so that the second frame 330 can be kept fixed to the first frame 320. The fixing portion 323 may be hook-coupled to the first frame 320 so that the second frame 330 can be kept coupled to the first frame 320 in a state in which it is adjacent to the first frame 320.

When the user presses one side of the second frame 330, the second frame 330 may separate from the fixing portion 323 and rotate with respect to the first frame 320.

The second frame 330 may be coupled to the first frame 320, as described above. A discharge portion 335 through which the washing water flows into the filter unit 300 may be provided at a front surface of the second frame 330. The discharge portion 335 may be formed by a plurality of discharge ports 336.

The discharge portion 335 may be formed in an inward direction of a radius of the second drum 210 or facing a rotation shaft A of the second drum 210. Thus, the flow direction of the washing water flowing in the circumferential direction of the second drum 210 may be changed to an inward radial direction of the second drum 210.

As described above, the insertion groove (not shown) into which the rotation protrusions 322 are inserted may be provided at one side of the second frame 330, and a handle 331 through which the user can rotate the second frame 330 may be provided at the other side of the second frame 330.

The second frame 330 may support the first valve member 341 and the second valve member 342. However, embodiments of the present disclosure are not limited thereto, and the first valve member 341 and the second valve member 342 may be supported on the first frame 320 or the cover member 310. The first valve member 341 and the second valve member 342 will now be described in detail.

A filter member 350, through which foreign substances are filtered before the washing water flowing into the filter unit 300 is discharged through the discharge portion 335, may be disposed at the rear side surface of the second frame 330. The filter member 350 may be disposed between the first frame 320 and the second frame 330.

The filter member 350 may be disposed in a position corresponding to the rear side surface discharge portion 335 of the second frame 330. As described above, the water current that occurs in the second drum 210 may be formed in the circumferential direction of the second drum 210, and the washing water flowing into the filter unit 300 in the circumferential direction of the second drum 210 may be discharged by the filter member 350 through the discharge portion 335 via the filter member 350.

Thus, the washing water flowing into the filter unit 300 through the first opening 311 or the second opening 312 may permeate the filter unit 350 and may be discharged out of the filter unit 300 through the discharge portion 335.

The filter member 350 may include a plurality of fine through-holes like the mesh member. Thus, the foreign substances in the washing water that permeates the filter member 350 may be collected in the filter member 350, and only washing water that does not include foreign substances may flow into the second drum 210 through the discharge portion 335.

As illustrated in FIG. 7, the user may rotate the second frame 330 by gripping the handle 331 of the second frame 330. The second frame 330 may be disposed in the opening portion 313 of the cover member 310 and exposed. Thus, the user may rotate the second frame 330 by gripping the handle 331.

When the second frame 330 is rotated, the filter member 350 disposed at the rear side surface of the second frame 330 may also be rotated together with the second frame 330 and exposed. Thus, the user may easily clean the filter unit 300 by removing the foreign substances that have been collected in the filter member 350 or the foreign substances collected by the filter member 350 between the first frame 320 and the filter member 350.

Hereinafter, the first valve member 341 and the second valve member 342 will be described in detail.

Figure 8:
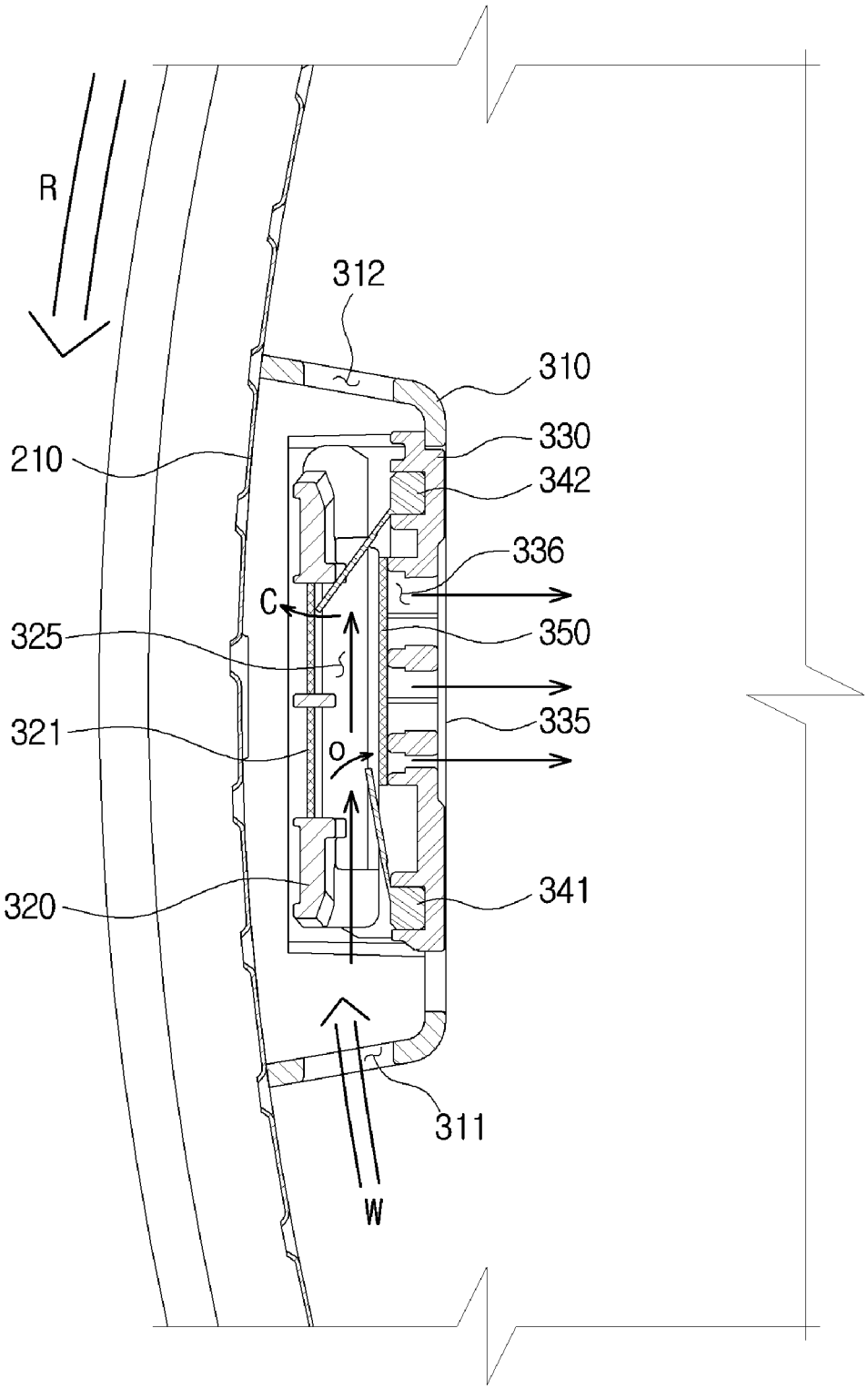
FIG. 8 is a cross-sectional view of a state in which washing water flows into one side of the filter of the second washing device of the washing machine of FIG. 6.
Figure 9:
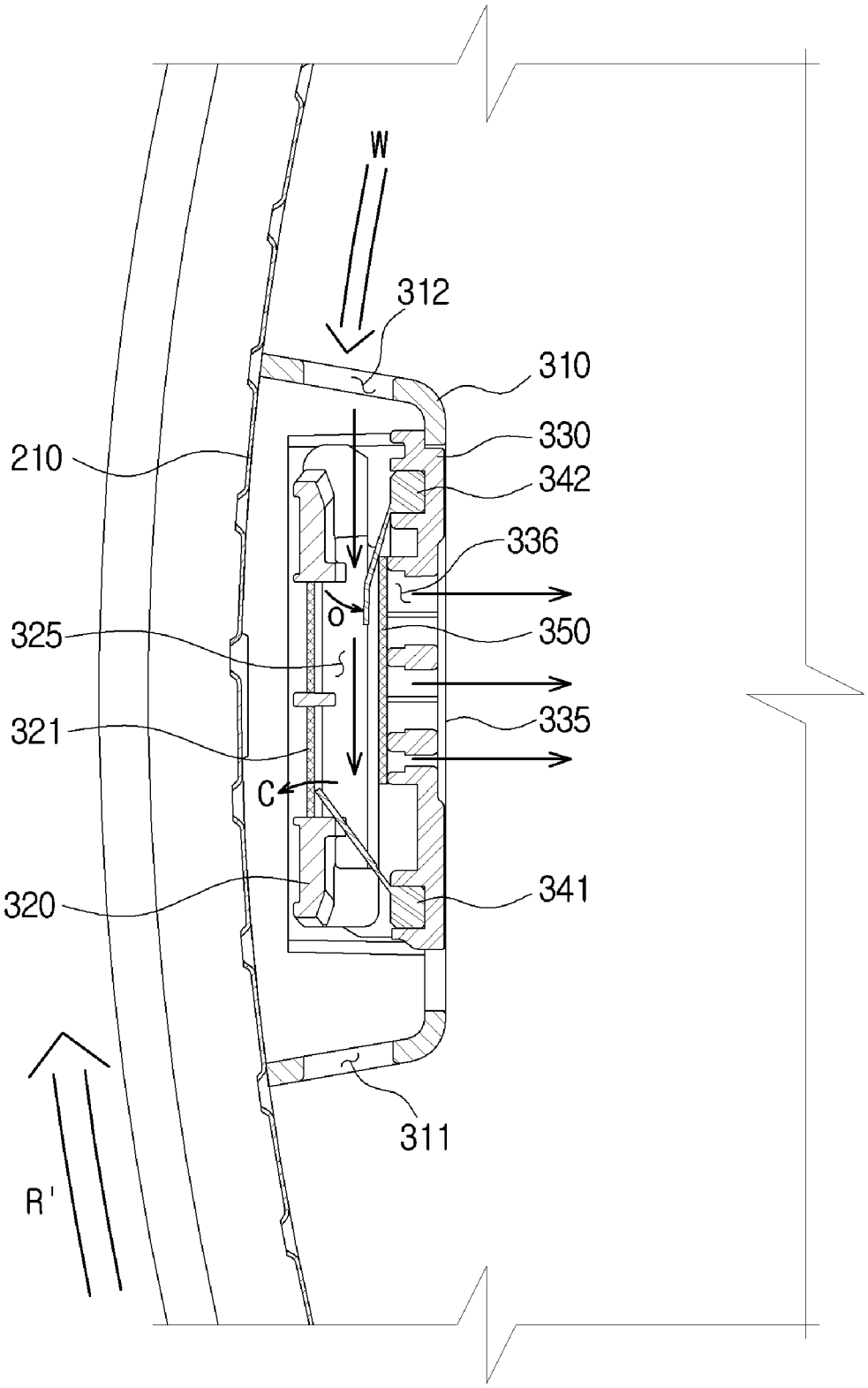
FIG. 9 is a cross-sectional view of a state in which washing water flows into the other side of the filter of the second washing device of the washing machine of FIG. 6.

FIG. 8 is a cross-sectional view of a state in which washing water flows into one side of the filter of the second washing device of the washing machine of FIG. 6, and FIG. 9 is a cross-sectional view of a state in which washing water flows into the other side of the filter of the second washing device of the washing machine of FIG. 6.

As illustrated in FIG. 8, when the second drum 210 is rotated in one direction R, the water current W is formed in a direction opposite the rotation direction R of the second drum 210. Thus, the water current W may flow into the filter unit 300 through the first opening 311 of the filter unit 300.

The washing water flowing into the first opening 311 presses the first valve member 341, disposed adjacent to the first opening 311, in a direction opposite the rotation direction R of the second drum 210 so that the first valve member 341 may be disposed in an open position O and the washing water may flow into a collecting portion 325 formed between the first frame 320 and the second frame 330.

One side of the collecting portion 325 is opened from the outside of the filter unit 300 by using the first valve member 341, and the other side of the collecting portion 325 is closed from the outside of the filter unit 300 when the second valve member 342 is in a closed position C.

The second valve member 342 may not be moved to the open position O but may be maintained in the closed position C when the second valve member 342 is pressed by the washing water in the direction opposite the rotation direction R of the second drum 210.

Thus, the washing water flowing into the collecting portion 325 does not flow into the second opening 312 but may be guided by the second valve member 342 to flow into the discharge portion 335.

Conversely, as illustrated in FIG. 9, when the second drum 210 is rotated in the opposite direction R', the water current W is formed in a direction opposite a rotation direction R' of the second drum 210. Thus, the water current W may flow into the filter unit 300 through the second opening 312 of the filter unit 300.

The washing water flowing into the second opening 312 presses the second valve member 342, disposed adjacent to the second opening 312, in a direction opposite the rotation direction R' of the second drum 210 so that the second valve member 342 may be in the open position O and the washing water may flow into the collecting portion 325.

One side of the collecting portion 325 is opened from the outside of the filter unit 300 by using the second valve member 342, contrary to the illustration in FIG. 8, and the other side of the collecting portion 325 is closed from the outside of the filter unit 300 when the first valve member 341 is in the closed position C.

The first valve member 341 may not be moved to the open position O and may be kept in the closed position C when the first valve member 341 is pressed by the washing water in a direction opposite the rotation direction R' of the second drum 210.

Thus, the washing water flowing into the collecting portion 325 through the second opening 312 does not flow into the first opening 311 but may be guided by the first valve member 341 and into the discharge portion 335.

Hereinafter, a driving shaft flange 290 that connects the second driving shaft 241, which is for transferring a rotational force to the second drum 210, to the second drum 210 will be described in detail.

Figure 10:
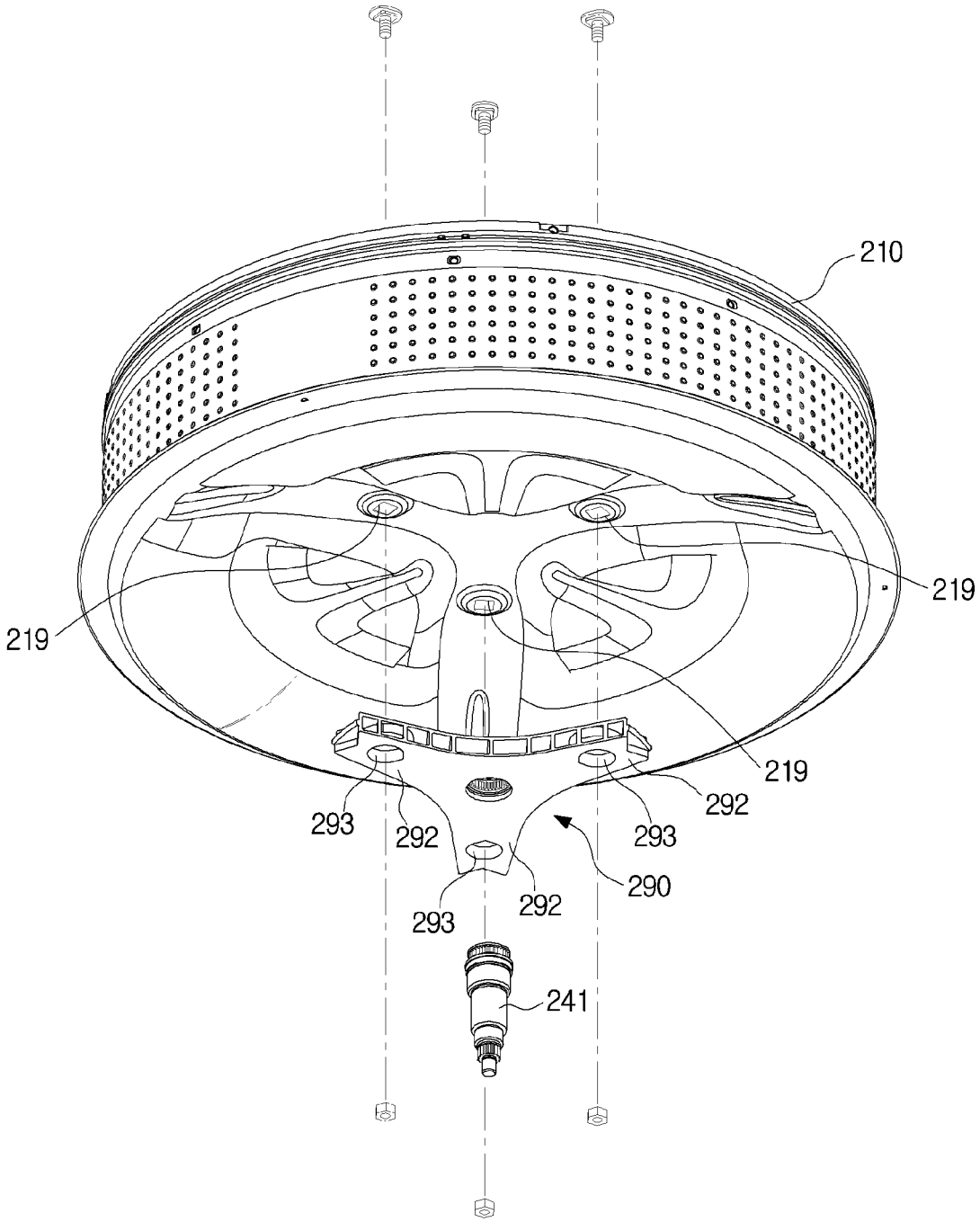
FIG. 10 is an exploded perspective view of a portion of the configuration of the second washing device of the washing machine of FIG. 1.
Figure 11:
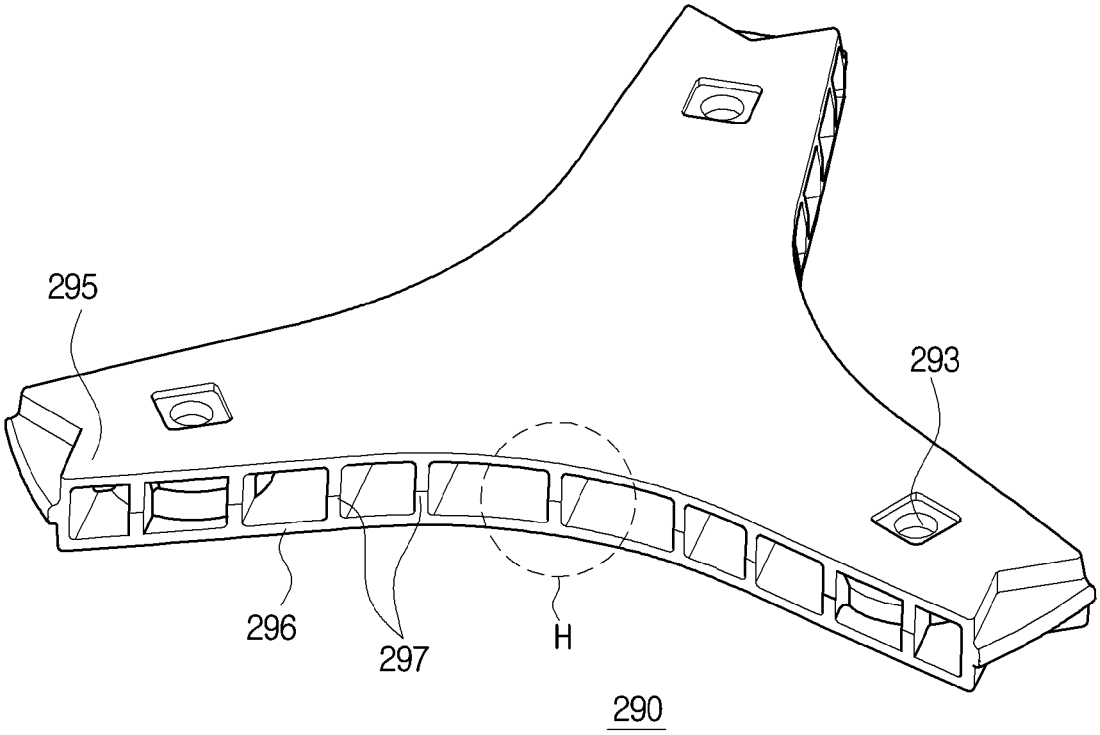
FIG. 11 is a perspective view of a driving shaft flange of the second washing device of the washing machine of FIG. 1.
Figure 12:
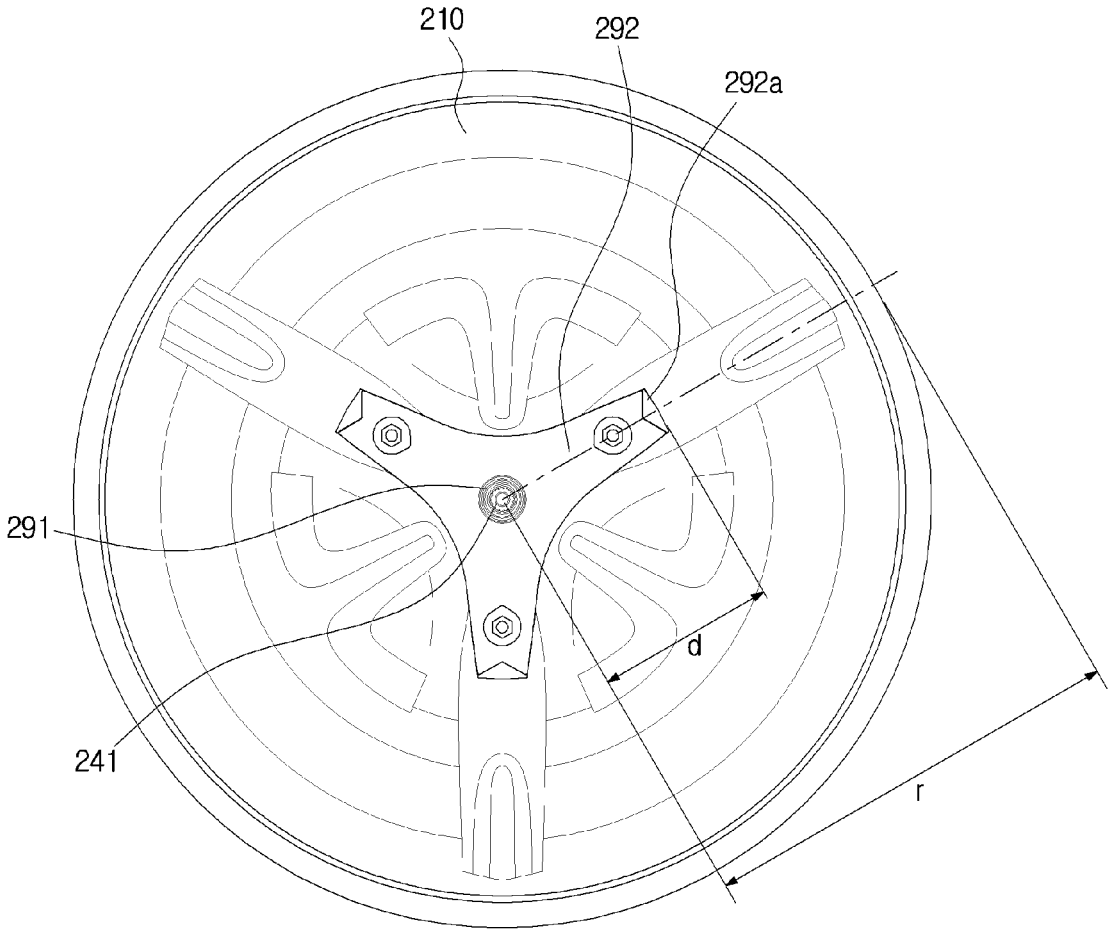
FIG. 12 is a bottom view of a portion of the configuration of the second washing device of the washing machine of FIG. 1.

FIG. 10 is an exploded perspective view of a portion of the configuration of the second washing device of the washing machine of FIG. 1, FIG. 11 is a perspective view of a driving shaft flange of the second washing device of the washing machine of FIG. 1, and FIG. 12 is a bottom view of a portion of the configuration of the second washing device of the washing machine of FIG. 1.

The driving shaft flange 290 may connect the second drum 210 to the second driving shaft 241 so that the rotational force generated by the second driving motor 240 may be transferred to the second drum 210 via the second driving shaft 241.

A driving shaft flange of a conventional fully automatic washing machine is formed as a structure that is disposed in the entire area of a lower portion of a drum to ensure rigidity and has a predetermined height in a vertical direction to ensure rigidity in the external transfer of force in the vertical direction, in particular.

However, in the washing machine 1 according to an embodiment of the present disclosure, the second drum 210 is disposed at an upper side of the first drum 110, and the first drum 110 and the second drum 210 are disposed inside the housings 130 and 230. Thus, a distance between a lower side of the second drum 210 and an upper side of the first drum 110 is relatively small.

Thus, when the height of the driving shaft flange 290 is tall to secure rigidity like a conventional driving shaft flange, a distance between the first drum 110 and the second drum 210 is so small that placement of the driving shaft flange 290 may be not easy.

Also, a variety of implements for driving the washing machine 1, except for the driving shaft flange 290, are disposed between the first drum 110 and the second drum 210 so that a space in which the driving shaft flange 290 is to be disposed may be narrow.

Thus, the driving shaft flange 290 needs to be disposed in a space narrower than that in which a conventional driving shaft flange is disposed. Thus, the volume of the driving shaft flange 290 needs to be reduced. Thus, rigidity of the driving shaft flange 290 may not be secured.

To solve the above-described problem, the driving shaft flange 290 of the washing machine 1 according to an embodiment of the present disclosure may include an improved structure that is small but capable of securing rigidity. In detail, the driving shaft flange 290 extends in a radial direction of the second drum 210 from a central portion 291 in which the second driving shaft 241 is inserted, and a length d of an arm member 292 connected to the second drum 210 is equal to or less than ½ of a radial length r of the second drum 210 so that the driving shaft flange 290 has a relatively shorter length in the radial direction of the second drum 210 than a conventional driving shaft flange, thus allowing space to be secured.

Also, instead of the driving shaft flange 290 having a short vertical height, the driving shaft flange 290 may include a first surface 295 and a second surface 296 parallel to each other in the vertical direction, and a connection portion 297 may be perpendicularly connected to the first surface 295 and the second surface 296 to ensure rigidity with respect to the external transfer of force.

As illustrated in FIG. 10, the driving shaft flange 290 may include the central portion 291 into which the second driving shaft 241 is inserted. The second driving shaft 241 may be rotated in one direction or an opposite direction while being inserted into the central portion 291. Thus, the driving shaft flange 290 may be in line with the second driving shaft 241 and rotated in one direction or an opposite direction.

The driving shaft flange 290 may include the arm member 292 that extends, centering on the central portion 291, in the radial direction of the second drum 210 and is coupled to a bottom surface of the second drum 210. A plurality of arm members 292 may be radially formed in the central portion 291.

One end of each arm member 292 may extend from the central portion 291 as described above, and a drum coupling portion 293 coupled to a lower portion of the second drum 210 may be disposed at the other side of the arm member 292 by using a coupling member.

The second drum 210 may include a coupling hole 219 in the vertical direction in a position corresponding to the drum coupling portion 293. The coupling hole 219 and the drum coupling portion 293 may be disposed in the vertical direction in a corresponding position and may be coupled to each other by a coupling member.

Thus, the central portion 291 is rotated by rotation of the second driving shaft 241, and due to rotation of the central portion 291, the arm member 292 that extends from the central portion 291 is in line with the central portion 291 and is rotated. The arm member 292 and the second drum 210 are coupled to each other by the coupling member. Thus, the second drum 210 may be rotated in line with rotation of the arm member 292.

As illustrated in FIG. 11, the driving shaft flange 290 may include the first surface 295 and the second surface 296, which are spaced apart from each other by a predetermined distance in the vertical direction and are parallel to each other, and an extension portion 297 that is disposed perpendicular to the first surface 295 and the second surface 296 and spread apart the first surface 295 and the second surface 296 in the perpendicular direction.

A plurality of extension portions 297 may be provided. The plurality of extension portions 297 may be spaced apart from each other by a predetermined distance in the radial direction of the second drum 210.

The first surface 295, the second surface 296, and one extension portion 297 may be provided in an H-beam form H. That is, the first surface 295, the second surface 296, and a plurality of extension portions 297 may have an H-beam shaped cross-section at a point in which the plurality of extension portions 297 connect the first surface 295 to the second surface 296.

The H-beam has a strong cross-sectional primary moment value with respect to a shearing force formed thereat due to pressure in the vertical direction or external pressure with respect to the vertical direction, so that rigidity with respect to external pressure in the vertical direction may be ensured.

Thus, the vertical cross-section of the driving shaft flange 290 may have a shape with a plurality of H-beams. Thus, the cross-section primary moment value of the driving shaft flange 290 is greatly increased so that, even when the height of the driving shaft flange 290 in the vertical direction is relatively short, rigidity with respect to external pressure may be maintained.

In addition, because rigidity of the driving shaft flange 290 is secured in spite of a small size as described above, even when a length extending in the radial direction of the second drum 210 is short, the driving shaft flange 290 may be stably coupled to the second drum 210.

In detail, a distanced from the central portion 291 of the arm member 292 of the driving shaft flange 290 to an outermost end 292*a* of the arm member 292 may be equal to or less than ½ of the radial length r of the second drum 210.

This is because, even though the driving shaft flange 290 does not have a long length in the radial direction of the second drum 210, the driving shaft flange 290 may ensure required rigidity due to the cross-sectional structure of the first surface 295, the second surface 296, and the connection portion 297.

Thus, the driving shaft flange 290 has a short height in the vertical direction that is an extension direction of a rotation shaft of the second drum 210 and the radial direction of the second drum 210, rigidity may be maintained, and the rotational force of the second driving shaft 241 may be stably transferred to the second drum 210, thus stably supporting the second drum 210 even in a narrow space.

According to the concept of the present disclosure, if necessary, laundry can be separated from each other and washed because a washing machine has a plurality of washing apparatuses. Also, a filter unit is disposed inside a drum having a rotation shaft that extends in a vertical direction and a water current inside the drum is formed in a direction opposite a rotation direction of the drum, foreign substances in the water current can be effectively collected by the filter unit. In addition, even though a length of a fixing arm of a driving shaft flange connected to a driving shaft for driving the drum is reduced, a cross-section of the fixing arm is reinforced so that the drum can be stably rotated.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a housing;

a drum rotatably disposed inside the housing;

a driving motor;

a driving shaft configured to transfer a rotational force from the driving motor to the drum; and a driving shaft flange configured to connect the driving shaft to the drum, wherein the driving shaft flange comprises:

a first surface;

a second surface substantially parallel to the first surface, the first surface and the second surface spaced apart from each other by a predetermined distance in a vertical direction of the drum; and an extension portion formed perpendicular to the first surface and the second surface, and connecting the first surface to the second surface, and wherein an edge of the first surface, an edge of the second surface, and an edge of the extension portion are substantially aligned in the vertical direction of the drum.

2. The washing machine according to claim 1, wherein the first surface, the second surface, and the extension portion are in an H-beam form having an 'H' shape such that at least a portion of a cross section of the driving shaft flange along an extending direction of the driving shaft is in the 'H' shape.

3. The washing machine according to claim 1, wherein the edge of the first surface, the edge of the second surface, and the edge of the extension portion are forming an 'H' shape.

4. The washing machine according to claim 1, wherein the extension portion has a plurality of extension portions, and wherein each of the plurality of extension portions is spaced apart along a radial direction of the drum.

5. The washing machine according to claim 4, wherein the driving shaft flange further includes:

a central portion into which the driving shaft is inserted; and an arm member formed to extend along the radial direction of the drum with respect to the central portion and coupled to a bottom surface of the drum.

6. The washing machine according to claim 5, wherein the first surface, the plurality of extension portions, and the second surface are disposed on the central portion and the arm member along an extending direction of the driving shaft, respectively.

* * * * *